United States Patent [19]

Nikolov et al.

[11] 4,227,033

[45] Oct. 7, 1980

[54] INDUCTION CRUCIBLE FURNACE

[75] Inventors: Ivan D. Nikolov; Pavel M. Minchev; Marin A. Dimitrov; Assen P. Georgiev; Iliya G. Chorbov, all of Sofia, Bulgaria

[73] Assignee: Institute po Metaloznanie i Technologia na Metalite, Sofia, Bulgaria

[21] Appl. No.: 15,647

[22] Filed: Feb. 27, 1979

[30] Foreign Application Priority Data

Feb. 27, 1978 [BG] Bulgaria ..... 38842

[51] Int. Cl.[2] ..... H05B 5/00

[52] U.S. Cl. ..... 13/27

[58] Field of Search ..... 13/26, 27, 35

[56] References Cited

U.S. PATENT DOCUMENTS 1,823,873 9/1931 Brace ..... 13/27 X 3,004,091 10/1961 Tama et al. ..... 13/27

*Primary Examiner*—Roy N. Envall, Jr.

*Attorney, Agent, or Firm*—Karl F. Ross

[57] ABSTRACT

An induction crucible furnace for the smelting of materials comprises a crucible which is surrounded by the induction coils and yoke which are mounted upon an intermediate vessel or shell closed by a cover overlying a mass of insulating material interposed between the crucible and inductor and the shell. The intermediate shell has an outwardly extending support flange by which it is mounted on an outward flange of the outer housing with clearance, the clearance likewise being filled with insulating material through openings formed in the flange of the intermediate shell inwardly of the wall of the housing. The flange of the latter projects beyond the flange of the intermediate member and a cover is connected to the housing flange to hermetically seal the system.

2 Claims, 2 Drawing Figures

INDUCTION CRUCIBLE FURNACE

FIELD OF THE INVENTION

This invention relates to an induction crucible furnace for melting metals under vacuum or under a gaseous medium under pressure.

BACKGROUND OF THE INVENTION

There are known induction crucible furnaces for melting metals under vacuum or under a gaseous meduim under pressure, in which the inductor surrounding the crucible with the molten metal and the screening magnetic yokes are fastened to the bottom or the side walls of the housing of the pressure-tight vessel.

A drawback of these furnaces lies in the necessity of providing significant assembly distances (spacings) between the inductor and the housing of the pressure-tight vessel, which results in an increase of the the overall size of the latter and to a reduction of the efficiency of the furnace because of the increased weight of the structure and the increased space to be evacuated or filled with gas. Moreover, there is a danger that in the event of piercing of the crucible the melt may reach the housing of the pressure-tight vessel and cause, because of its high temperature, a local reduction of its strength and an eventual failure resulting with an explosion-like ejection of hot metal into the workroom.

OBJECT OF THE INVENTION

It is therefore a general object of the present invention to avoid the aforementioned drawbacks by providing an induction crucible furnace for melting under vacuum or in a gaseous medium under pressure, which has minimum sizes of the pressure-tight vessel and of the free spaces inside it, as well as an increased service reliability with respect to the protection of the pressure-tight vessel from any contact with the molten metal.

SUMMARY OF THE INVENTION

This object is attained with an induction crucible furnace for melting metals under vacuum or under a gaseous medium under pressure, comprising an inductor, magnetic yokes and a body or housing of a pressure-tight vessel with a cover. The inductor and the magnetic yokes are fastened to an intermediate jacket, and the magnetic yokes are pressed radially to the inductor by means of fasteners passing through the intermediate jacket. The intermediate jacket with the inductor and magnetic yokes inside it is disposed inside the body of the pressure-tight vessel and is fastened rigidly by means of a ring at its upper end to the flange of the body of the pressure-tight vessel. The space between the inductor, the magnetic yokes, the intermediate jacket and the body of the pressure-tight vessel is filled with refractory material. The diameter of the flange of the body of the pressure-tight vessel is larger than that of the carrying ring of the intermediate jacket, and to the same flange there is fastened a seal between it and the cover. The diameter of the seal is also larger than the diameter of the carrying ring. The fasteners for pressing the magnetic yokes to the inductor are the bolts of a screw-type joint connected with the intermediate jacket.

The advantages of the inventions include minimum free spaces between the inductor and the body of the pressure-tight vessel and minimum sizes of the pressure-tight vessel because the inductor and the magnetic yokes can be affixed to the intermediate jacket before the insertion of the latter into the pressure-tight vessel. This leads to savings of materials in the fabrication of the pressure-tight vessel and of working gas during the melting in a gaseous medium under pressure, and also to a reduction of the time for filling the pressure-tight vessel with working gas or the time of evacuation, respectively.

The invention also affords increased safety of the furnace with respect to the contact of liquid metal with the walls of the body of the pressure-tight vessel in the case of a breakdown of the wall of the crucible. Another advantage is the possibility for maximum spacing of the seal of the pressure-tight vessel away from the hot area, without increasing the overall sizes of the furnace.

BRIEF DESCRIPTION OF THE DRAWING

For a better understanding of the invention, reference should be made to the accompanying drawing, in which there is illustrated a preferred embodiment of an induction crucible furnace for melting metals under vacuum or under a gaseous medium under pressure in accordance with the invention. In the drawing

SPECIFIC DESCRIPTION

Figure 1:
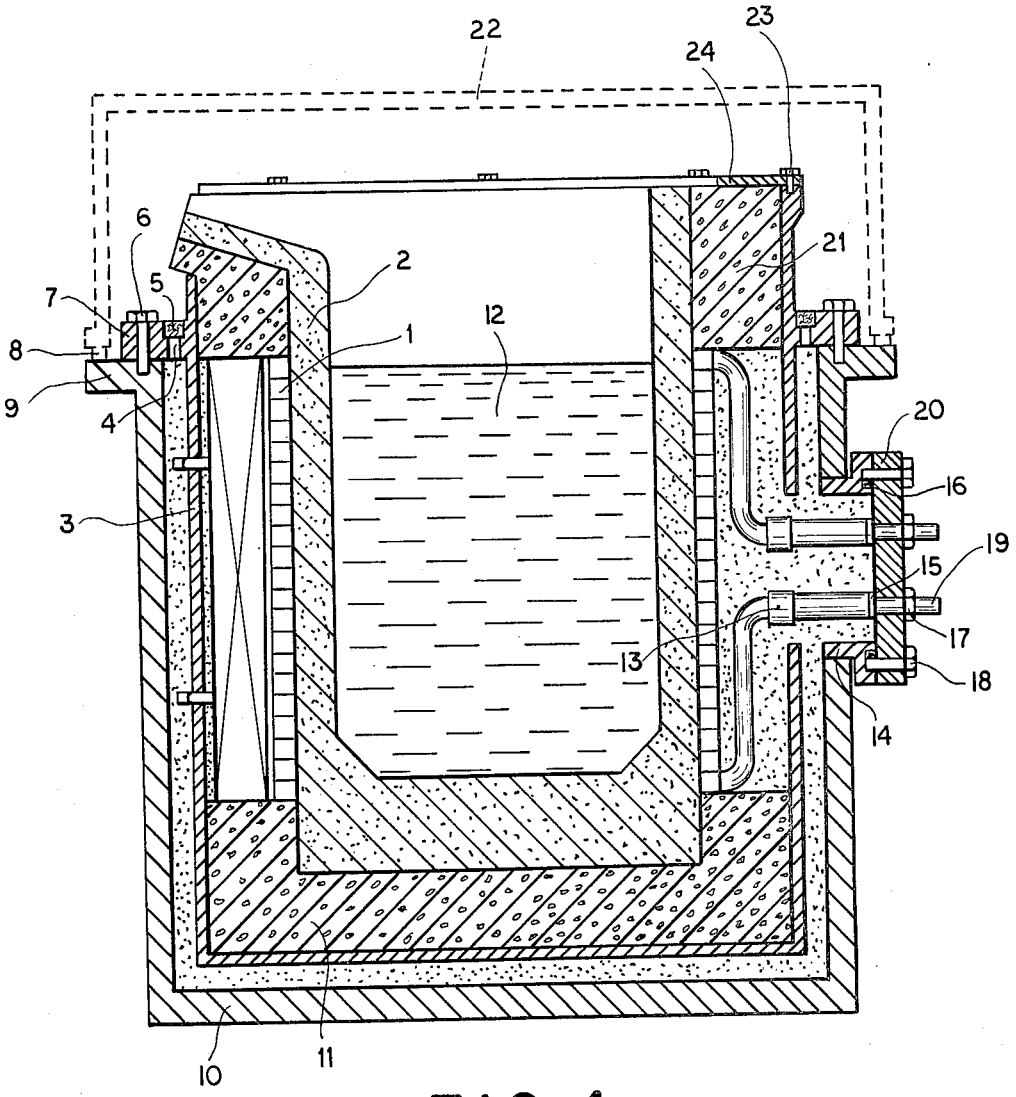
FIG. 1 is a side cross-sectional view of the furnace.
Figure 2:
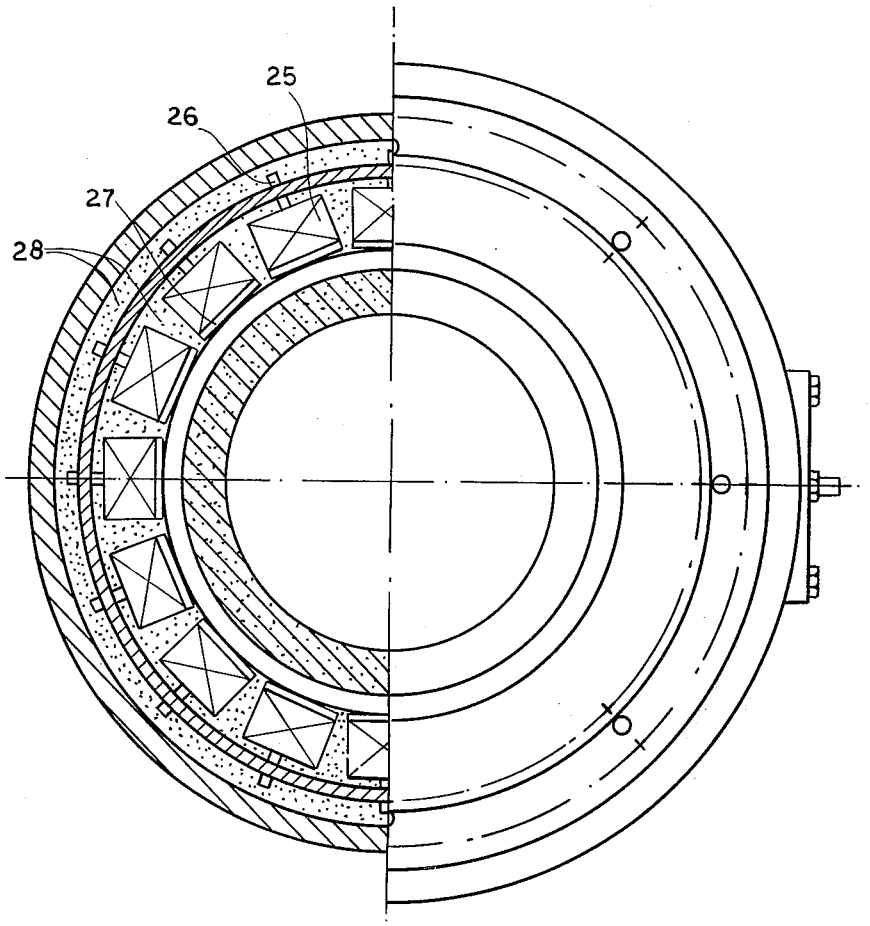
FIG. 2 is a top view and a partial cross-section of the furnace.

The inductor 1 and the magnetic yokes 25 are fastened inside the intermediate jacket 3. The magnetic yokes 25 are pressed radially against the inductor 1 by means of fasteners 26, which pass through the intermediate jacket 3. The fasteners 26 represent the bolts of a screw-type joints with the intermediate jacket 3. The magnetic yokes 25 are electrically insulated from the inductor 1 by means of insulating gaskets 27. The inductor 1 and the magnetic yokes 25 are fixed axially with respect to the intermediate jacket 3 by the floor refractory 11 and the top refractory 21, being pressed by the cover 24, which is fastened to the intermediate jacket 3 by means of bolts 23. The intermediate jacket 3 with the attached inductor 1 and magnetic yokes 25 is disposed inside the body of the pressure tight vessel 10 and is fastened rigidly by means of the carrying ring 7 in its upper end and bolts 6 to the flange 9 of the body of the pressure-tight vessel 10. Inside the inductor 1, the floor refractory 11 and the top refractory 21 there is rammed the crucible 2 which receives the melt 12.

The outlets 19 of the furnace are connected to the inductor 1 by means of water-cooled electric connections 13. The seals between the outlets 19 and the through plate 20 are pressed by means of the nuts 17. The seal 16 between the plate 20 and the flange 14 of the body of the pressure-tight vessel 10 is pressed by means of bolts 18.

The space between the inductor 1, the magnetic yokes 25, the intermediate jacket 3 and the body of the pressure-tight vessel 10 is filled with refractory material 28. In the carrying ring 7 there are bored holes 4 for pouring-in refractory material 28, and in the same holes 4 there are provided gas-permeable filters 5.

Flange 9 of the body of the pressure-tight vessel 10 has a diameter which is larger than that of the carrying ring 7 of the intermediate jacket 3, and to the same flange 9 there is fastened the seal 8 between it and the cover 22. The diameter of seal 8 is also larger than the diameter of the carrying ring 7.

The induction crucible furnace in accordance with the invention is loaded with material to be subjected to melting; it is then closed tightly by cover 22. Then it is evacuated or filled with pressurized gas, through cover 22 for example, and at the same time the furnace is connected to the electric mains by means of the outlets 19, as in known furnaces of this type. The design of the furnace, unlike the known ones, provides a possibility for the case of an eventual piercing of crucible 2, for the liquid metal 12 which is under pressure, to reach only the refractory 28 and there to solidify, without coming in contact with the body 10.

What we claim is:

1. An induction crucible furnace comprising:

an upwardly open housing formed with a bottom wall and a cylindrical upright wall having an outwardly extending flange;

an upwardly open intermediate vessel received in said housing and having a bottom wall spaced above the bottom wall of said housing and an upright cylindrical wall spaced inwardly from the cylindrical wall of said housing, said cylindrical wall of said vessel being formed with an outwardly extending support flange overlying and terminating inwardly of the flange of said housing;

a mass of insulating material filling the space between said cylindrical walls and said bottom walls;

a crucible for receiving a melt received within said vessel and spaced inwardly therefrom;

induction heating means surrounding said crucible and received within said vessel, said induction heating means including induction heating coils and yokes;

fastener means including bolts traversing said cylindrical wall of said vessel for securing said induction heating means and said crucible in said vessel;

insulating means interposed between said crucible and said vessel around said induction heating means; and a cover fitted over said crucible, said vessel and said housing and sealingly engaging the flange of said housing outwardly of the flange of said vessel to enable selective pressurization and evacuation of a space above the melt in said crucible.

2. The furnace defined in claim 1 wherein the flange of said vessel is formed inwardly of the cylindrical wall of said housing the passage enabling the introduction of said material into said space between said cylindrical walls of said vessel and housing.

* * * * *